US005600977A

United States Patent [19]

Piron

[11] Patent Number: 5,600,977

[45] Date of Patent: Feb. 11, 1997

[54] MAGNETIC LOCKING DEVICE

[75] Inventor: Ludwig Piron, Waterloo, Canada

[73] Assignee: Pinel Medical Inc., Waterloo, Canada

[21] Appl. No.: 547,776

[22] Filed: Oct. 25, 1995

[51] Int. Cl.[6] ..... E05B 73/00

[52] U.S. Cl. ..... 70/57.1; 24/704.1; 70/276

[58] Field of Search ..... 70/33, 34, 57.1, 70/276, 413; 24/704.1

[56] References Cited

U.S. PATENT DOCUMENTS

| | | | |
|---|---|---|---|
| 3,638,285 | 2/1972 | Sanchez Giraldez | 24/108 |
| 4,716,922 | 1/1988 | Camp | 70/276 X |
| 4,745,664 | 5/1988 | Damvig | 24/704.1 |
| 4,884,833 | 12/1989 | Pedersen | 24/704.1 X |

*Primary Examiner*—Lloyd A. Gall
*Attorney, Agent, or Firm*—R. Craig Armstrong

[57] ABSTRACT

A locking device has a non-magnetic pin and a button, the non-magnetic pin having a base and a post projecting perpendicularly therefrom, extending to a free end, with an indented portion close to the free end. The button is an enclosed non-magnetic unit, having a hole at the lower surface adapted to receive the free end of the post, and also enclosing a plurality of locking plates each supported at an outer portion by a compressible support material, and adapted to retain the pin at the indented portion in a locked position within the button, but to rotate upwards and release the pin in response to a magnetic force directed at the upper surface of the button. The magnetic force can be applied by a magnet mounted within a protective shield adapted to fit over the button.

6 Claims, 2 Drawing Sheets

MAGNETIC LOCKING DEVICE

BACKGROUND OF THE INVENTION

This invention relates to a locking device, with a magnetic key release. Such devices are particularly intended for use in patient safety restraints in medical and nursing care situations, but obviously could have many other applications.

Such locking devices when used with a system of interchangeable and variable belts or straps can enable professional medical staff to provide a safe and appropriate restraint to meet the needs of each specific patient, the devices being used to secure the straps or belts to each other through suitable holes.

Existing devices, such as the one shown in U.S. Pat. No. 3,638,285, provide a two-part locking button, with a magnetic key release, but suffer from the serious disadvantage of requiring a high strength magnet, which can cause interference with delicate electronic equipment in a hospital room, or with other equipment such as a pacemaker within a patient.

SUMMARY OF THE INVENTION

It has been found that the risk of interference with other equipment can be substantially reduced, to an acceptable level, by providing a key having features to minimize magnetic flux, and by providing for much smaller distances between the magnetic portion of the key and the locking means within the button portion of the device, so that the strength of the magnet can be reduced without reducing the strength of the device below the necessary level for actuation of the device.

The locking device comprises a pin and a button, the non-magnetic pin having a base and a post extending perpendicularly therefrom and having a free end, with an indented portion close to the free end. The button is an enclosed non-magnetic unit, having a hole at the lower surface adapted to receive the free end of the post, and enclosing a plurality of locking plates each supported at an outer portion by a compressible support material. The locking plates are adapted to retain the post at the indented portion in a locked position within the button, but to rotate upwards and release the post in response to a magnetic force directed at the upper surface of the button. The magnetic force can be applied by a magnet mounted within a protective shield adapted to fit over the button. The shield has an enclosed upper end, and substantially cylindrical side walls defining an opening adapted to receive a substantial portion of said casing unit of the button.

The post is passed through holes in the straps or belts, and then the button is applied, so that the straps are trapped between the base and the button (the holes being considerably smaller in diameter than either the base or the button).

The locking device provides a very strong and secure lock with ease of handling, and is particularly advantageous for institutional use for patient restraints, with unlocking access being restricted to professional staff.

BRIEF DESCRIPTION OF THE DRAWINGS

The invention will now be described with reference to preferred embodiments by way of example, as illustrated in the accompanying drawings, in which.

DETAILED DESCRIPTION OF THE PREFERRED EMBODIMENT

Figure 1:
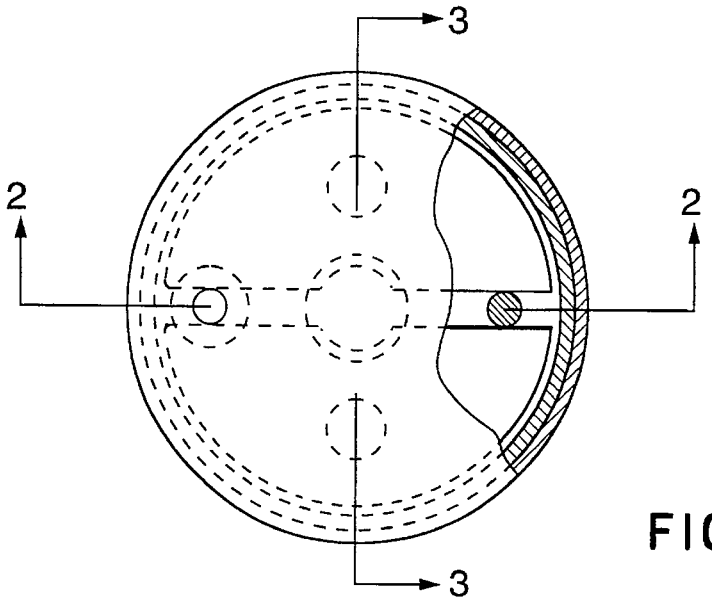
FIG. 1 is a partially cut away top view of a preferred embodiment of the invention.
Figure 2:
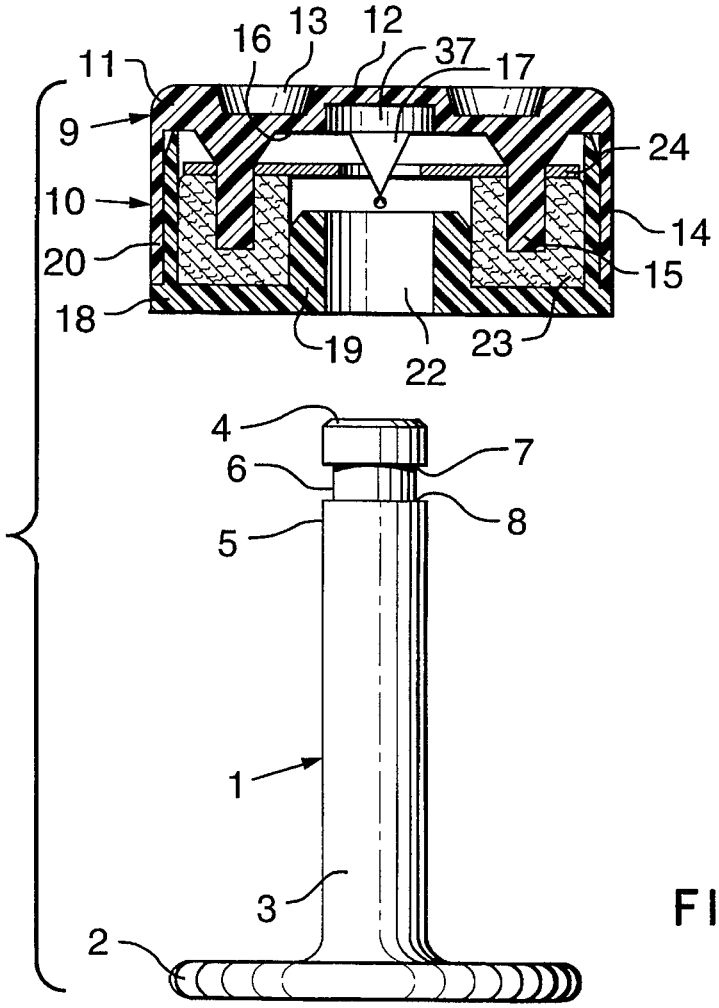
FIG. 2 is a sectional view along the line 2—2 in FIG. 1.

Referring firstly to FIG. 2, a pin I has a base 2, an elongated cylindrical post section 3, having an indent 6 in the upper portion 5, spaced a predetermined distance from the upper end surface 4.

A button 9 comprises a casing unit 10 surrounding a cylindrical button hole 22. The casing unit comprises an upper portion 11 which engages with a lower portion 18 to form an enclosed unit. The two portions 11 and 18 are preferably of a highly durable plastic material which can be sealed by any suitable method, preferably by ultrasound welding at appropriate points of contact between cylindrical sidewalls 14 and 20. An upper surface 12 of the upper portion 11 includes a trench 13. An upper inside surface 16 includes a circular indented portion 37 adapted to receive the upper end surface 4 of the post 1. Support posts 15 are of integral construction with the upper portion 11. The lower portion 18 has a cylindrical shoulder portion 19 defining the button hole 22. An upper inside surface of the lower portion, together with shoulder portion 19 and sidewall 20, define a cavity containing a compressible support material 23, preferably foam, supporting a locking plate 24.

Figure 3:
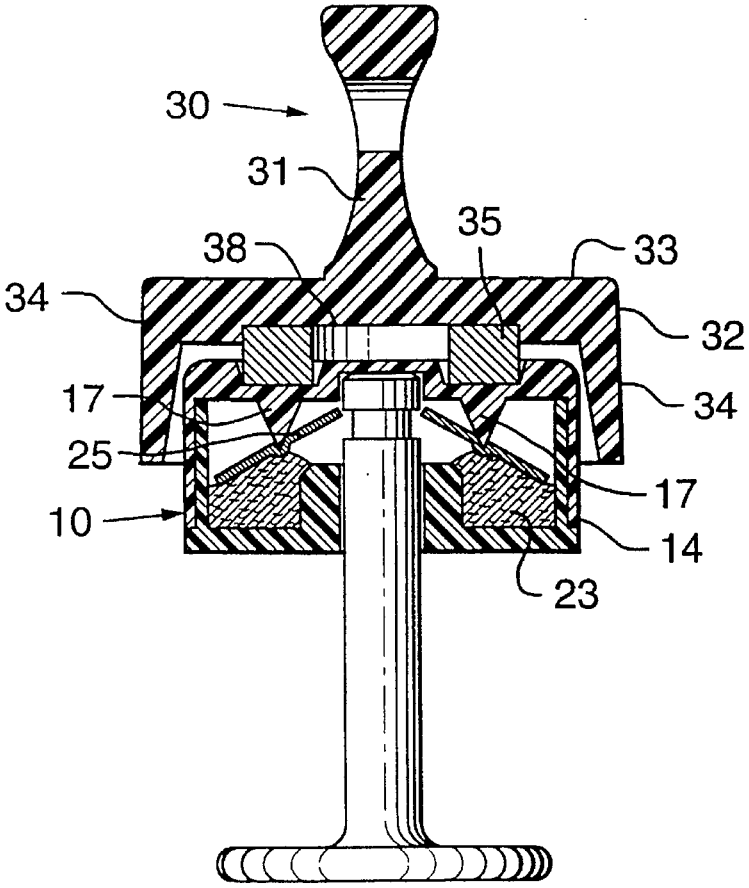
FIG. 3 is a sectional view along the line 3—3 in FIG. 1, showing the device in an unlocked position.
Figure 4:
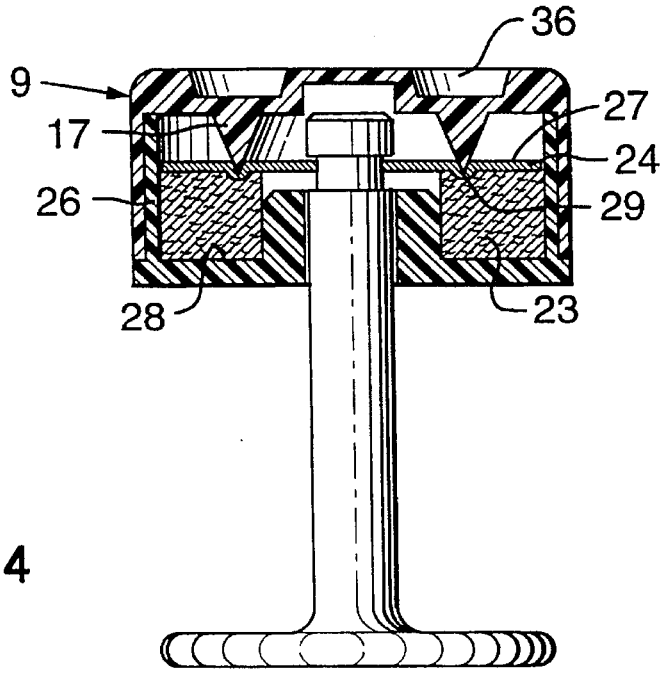
FIG. 4 is a sectional view along the line 3—3 in FIG. 1, showing the device in a locked position.

Referring to FIGS. 3 and 4, a magnet 30 comprises a handle 31 and a protective shield 32, having an upper casing 33 extending to projections 34 having a configuration to provide clearance from the sidewalls 14 of the button casing unit 10 when the magnet is placed over the unit. On the lower surface 38 of the upper casing 33, a magnet 35 is affixed at indent 36, so as to be aligned with and engage the trench 13 when in use for unlocking the button 9.

Within the casing unit 10, locking plates 24 are each supported by the support material 23 along a lower surface 28, between a sidewall end 26 and an indented pivot point 29 which is aligned with a pivot post 17. The engaging end 25 of each locking plate 24 is aligned so as to engage the indent 6 of the post 1 for a locked position, but to rotate clear of the upper angle 7 for an unlocked position.

Referring to FIGS. 3 and 4, the operation of the device is shown. Referring firstly to FIG. 4, the post 1, after being passed through the item to be locked, is inserted into the button hole 22, and as the upper portion 5 passes the locking plate 24, the plate is pushed by the upper portion of the post into an upwards rotation until the post reaches the position shown in FIG. 4, at which stage the locking plate 24 has rotated downwards and is secured within the limits between the upper angle 7 and the lower angle 8 of the indent 6, and the post is locked within the butten. The locking plates 24 must be sized to extend into the indent 6 sufficiently so that there will be secure contact between the upper surface 27 of the plates and the upper angle 7 of the indent 6 when the button is moved upwards while the plates are in an unrotated position.

Once the button is in position on the post, the foam support ensures that the plates remain in a position substantially parallel to the upper and lower surfaces of the button and perpendicular to the post, so that the plates remain within the indent and the button remains firmly locked and able to withstand the expected forces. If the device is used in an inverted position which would result in gravitational force tending to rotate the locking plates towards the upper surface of the casing unit, the foam support means exerts a sufficient counteracting force to prevent such rotation.

To unlock the button, as seen from FIG. 3, the magnet 30 is placed over the casing unit 10 of the button, so that the magnet 35 engages the trench 13 on the upper surface 12 of the upper portion 11 of the casing unit. The protective shield 32 and projections 34 operate as a guide in accurate placement of the magnet, and assist in retaining the magnet in position over the casing unit 10. As the magnetic force operates on the locking plate 24, the post is moved up into the indent 37, and the locking plate rotates upwards to pass free from the indent 6 at the upper angle 7. At this stage, the button can be lifted from the post, and the post is then removed from the previously locked item.

The projections 34 of the protective shield 32 of the magnet are preferably constructed with sufficient gap between them so that the user of the device can lift the button and the magnet in the same hand. The handle 31 can readily be adapted for hands-free carrying when not actually in use, for example by a hole through which a carrying chain can be inserted.

The pin 1 is constructed of a strong non-magnetic material, preferably brass or stainless steel. The casing unit 10 is constructed of a very strong material, preferably plastic, capable of resisting breakage under any human-invoked pressures. The locking plates 24 are constructed of a high density ferrous material such as 320 stainless steel. The magnet is preferably constructed of a magnetic material having a stronger magnetic forces relative to density than conventional magnets, while extending its magnetic flux for a minimal distance. A suitable material is a polymer bonded neodymium material. The handle 31 is preferably constructed of a strong material such as a strong nylon, to minimize breakage or sharp portions. As the magnet is affixed within the protective shield 32, accidental proximity to magnetic sensitive devices is avoided.

What is claimed as the invention is:

1. A locking device comprising a pin and a button; said pin being non-magnetic and comprising a post portion substantially perpendicular to and affixed at one end to a base, and having a free end, and a perimetric indent spaced at a predetermined distance from said free end; said button comprising a substantially cylindrical enclosed casing unit surrounding at its lower surface a hole adapted to receive said free end of said pin, said casing unit enclosing a plurality of locking plates each supported at an outer portion of a support means constructed of a compressible foam material, said locking plates each being adapted to retain said post at said indent in a locked position within said button but to rotate towards an upper surface of said casing unit and to release said post in response to a magnetic force of a magnet operating at said upper surface, said hole being defined by a shoulder portion extending upwardly from said lower surface to define a cavity between said shoulder portion and an outer side wall of the button, said cavity being substantially filled with said foam material between said shoulder portion and said side wall, wherein said foam material extends above an upper free end surface of said shoulder portion to support said locking plates.

2. A locking device as claimed in claim 1 wherein each said locking plate is adapted to pivot about a pivot means on rotation in response to said magnetic force.

3. A locking device as claimed in claim 1 wherein said magnetic force is provided by a release means comprising a magnet substantially enclosed within a protective shield constructed of a non-magnetic material.

4. A locking device as claimed in claim 1 wherein the upper surface of said casing unit has an indented portion adapted to receive a protruding portion of said magnet.

5. A locking device as claimed in claim 1 wherein said magnet is constructed of polymer bonded neodymium.

6. A locking device as claimed in claim 1 wherein said casing unit is constructed of a highly resilient plastic material.

* * * * *